US009144138B2

(12) United States Patent
Xie

(10) Patent No.: US 9,144,138 B2
(45) Date of Patent: Sep. 22, 2015

(54) DIMMABLE TORCH

(71) Applicants: Nextorch Industries Co., Ltd., Yangjiang (CN); Power Source Industries Co., Ltd., Yangjiang (CN); Wave Power Source Police Equipments Co., Ltd., Yangjiang (CN)

(72) Inventor: Zongyuan Xie, Shaoguan (CN)

(73) Assignees: NEXTORCH INDUSTRIES CO., LTD. (CN); POWER SOURCE INDUSTRIES CO., LTD. (CN); WAVE POWER SOURCE POLICE EQUIPMENTS CO., LTD. (CN)

( * ) Notice: Subject to any disclaimer, the term of this patent is extended or adjusted under 35 U.S.C. 154(b) by 0 days.

(21) Appl. No.: 14/149,033

(22) Filed: Jan. 7, 2014

(65) Prior Publication Data

US 2014/0117876 A1 May 1, 2014

Related U.S. Application Data

(63) Continuation-in-part of application No. PCT/CN2012/078305, filed on Jul. 6, 2012.

(30) Foreign Application Priority Data

Jul. 8, 2011 (CN) ..... 2011 1 0197803

(51) Int. Cl.

| | |
|---|---|
| ***H05B 37/02*** | (2006.01) |
| ***F21L 4/00*** | (2006.01) |
| ***H05B 33/08*** | (2006.01) |
| ***F21L 4/02*** | (2006.01) |
| ***F21V 23/04*** | (2006.01) |
| *F21Y 101/02* | (2006.01) |

(52) U.S. Cl.

CPC . *H05B 37/02* (2013.01); *F21L 4/00* (2013.01); *F21L 4/027* (2013.01); *F21V 23/04* (2013.01); *F21V 23/0421* (2013.01); *H05B 33/0815* (2013.01); *F21Y 2101/02* (2013.01)

(58) Field of Classification Search

CPC ..... H05B 37/02; F21L 4/00; F21L 4/027; F21V 21/0885; F21V 23/0421

USPC ..... 315/291, 200 A; 362/157, 202, 205, 206

See application file for complete search history.

(56) References Cited

U.S. PATENT DOCUMENTS

| | | | | |
|---|---|---|---|---|
| 2005/0077837 | A1* | 4/2005 | Kim et al. | 315/200 A |
| 2008/0272714 | A1 | 11/2008 | Noble et al. | |
| 2011/0084631 | A1 | 4/2011 | Koch et al. | |

FOREIGN PATENT DOCUMENTS

| | | | |
|---|---|---|---|
| CN | 201059428 | Y | 5/2008 |
| CN | 201757283 | U | 3/2011 |
| CN | 201836655 | U | 5/2011 |
| CN | 202152927 | U | 2/2012 |

OTHER PUBLICATIONS

International Search Report for corresponding application PCT/CN2012/078305 filed Jul. 16, 2014; Mail date Oct. 6, 2012.

* cited by examiner

*Primary Examiner* — Daniel D Chang
(74) *Attorney, Agent, or Firm* — Cantor Colburn LLP

(57) ABSTRACT

The disclosure provides a dimmable torch, in order to overcome the insufficiency of the dimming control function of the torch in the prior art. The torch comprises a lamp holder (1), a tube body (3) and a tail cap (5), wherein a battery (10) is arranged in the tube body (3); a control circuit (9) is arranged in the tail cap (5) of the torch; the second end (V−) of the control circuit is connected with the cathode of the battery (10); a microcomputer control system (8) on the control circuit (9) can control the on/off of a loop of the cathode of the second end of the driving circuit (11) and the cathode of the battery (10) to implement dimming. Due to the disclosure, the grouped multi-gear dimming mode of the torch can be controlled conveniently.

5 Claims, 3 Drawing Sheets

DIMMABLE TORCH

CROSS REFERENCE TO RELATED APPLICATIONS

This application is a continuation-in-part of International Patent Application No. PCT/CN2012/078305 filed on 6 Jul. 2012 which claims priority to Chinese Patent Application No. 201110191803.6 filed on 8 Jul. 2011, both of which said applications are herein incorporated by reference in their entirety.

TECHNICAL FIELD OF THE DISCLOSURE

The disclosure relates to the field of lighting, and relates to a torch, in particular to a dimmable torch.

BACKGROUND OF THE DISCLOSURE

At present, the tail cap of a torch controlled by a tail switch is mainly composed of a tail cap shell, a button switch and some simple parts. Usually, the tail cap of the torch can only realize a simple on-off function and does not have group multi-gear dimming control function in itself. The conventional grouped multi-mode dimmable torch generally implements the grouped multi-mode control function for the dimming of the torch by continuously clicking the switch or under the separate control of a plurality of separate switches, so as not to be simple and convenient enough in operation.

In the prior art, there is still no effective solution for solving the problem of complex grouped multi-mode dimming operation at present.

SUMMARY OF THE DISCLOSURE

The main objective of the disclosure is to provide a dimmable torch, to solve the problem of complex grouped multi-mode dimming operation in the prior art.

To implement the objective above, in one aspect, a dimmable torch is provided, which includes a lamp holder, a tube body and a tail cap, wherein a battery is arranged in the tube body and a dimmable light source is arranged in the lamp holder. The dimmable torch is characterized in that a control circuit is arranged in the tail cap and is provided with a multi-gear regulating button and a microcomputer control system; and the tail cap of the torch is only provided with two electric connection points for connecting with the outside.

Preferably, the dimmable torch further includes: a tube body conductor and a driving circuit, wherein the driving circuit is arranged in the lamp holder; a first end of the driving circuit is connected with the dimmable light source; the anode and cathode of a second end of the driving circuit are connected with the anode of the battery and the tube body conductor respectively; a first end V+ of the control circuit is connected with the tube body conductor and is further conductively connected with the cathode of the second end of the driving circuit by the tube body conductor; a second end V− of the control circuit is connected with the cathode of the battery; the control circuit is conductively connected with the battery by the driving circuit; the microcomputer control system on the control circuit can control the on/off of a loop of the cathode of the second end of the driving circuit and the cathode of the battery to implement dimming; the control circuit is only provided with two electric connection points: the first end V+ and the second end V−; and the multi-gear regulating button is connected with the input end of the microcomputer control system to input a regulation instruction to the microcomputer control system.

Preferably, the control circuit is included in the tail cap of the torch; the multi-gear regulating button is used for pushing the microcomputer control system to regulate the brightness of the torch; and the tail cap of the torch is only provided with two electric connection points for connecting with the outside: the first end V+ and the second end V− of the control circuit.

Preferably, the control circuit includes a voltage reducing and stabilizing chip U31, a first single chip computer U32, a first field effect transistor Q31, a first capacitor C31, a second capacitor C32, a third capacitor C33, a first diode D31, a first resistor R31, a second resistor R32 and the multi-gear regulating button, wherein the first pin of the voltage reducing and stabilizing chip U31 is connected with the first end V+ of the control circuit; the third pin is connected with the second end V− of the control circuit, and the second pin of the voltage reducing and stabilizing chip U31 is connected with the anode end of the first diode D31.

Preferably, the second pin of the first single chip computer U32 is connected with the second end V− of the control circuit; the third pin of the first single chip computer U32 is connected with the grid of the first field effect transistor Q31; the fourth pin of the first single chip computer U32 is connected with the second end SW2 of the multi-gear regulating button and the first end of the second resistor R32; the fifth pin of the first single chip computer U32 is connected with the cathode end of the first diode D31, the first end of the second capacitor C32, the first end of the third capacitor C33, the second end of the first resistor R31 and the second end of the second resistor R32; the sixth pin of the first single chip computer U32 is connected with the first end SW1 of the multi-gear regulating button and the first end of the first resistor R31; the drain of the first field effect transistor Q31 and the first end of the first capacitor C31 are connected with the first end V+ of the control circuit; and the source of the first field effect transistor Q31, the second end of the first capacitor C31, the second end of the second capacitor C32, the second end of the third capacitor C33 and the third end of the multi-gear regulating button are connected with the second end V− of the control circuit.

Preferably, the control circuit further includes a second single chip computer U41, a second field effect transistor Q41, a fourth capacitor C41, a fifth capacitor C42, a first inductor L41, a second diode D41, a third diode D42, a voltage stabilizing diode Z41, a third resistor R41, a fourth resistor R42 and the multi-gear regulating button, wherein the second pin of the second single chip computer U41 is connected with the second end V− of the control circuit, the third pin of the second single chip computer U41 is connected with the grid of the second field effect transistor Q41, the fourth pin of the second single chip computer U41 is connected with the second end SW2 of the multi-gear regulating button and the first end of the fourth resistor R42, the fifth pin of the second single chip computer U41 is connected with the cathode end of the third diode D42, the first end of the fifth capacitor C42, the cathode end of the voltage stabilizing diode Z41, the second end of the third resistor R41 and the second end of the fourth resistor R42, and the sixth pin of the second single chip computer U41 is connected with the first end SW1 of the multi-gear regulating button and the first end of the third resistor R41;

the first end of the first inductor L41 and the cathode end of the second diode D41 are connected with the first end V+ of the control circuit; the second end of the first inductor L41, the first end of the fourth capacitor C41 and the anode end of the third diode D42 are connected with the drain of the second field effect transistor Q41; and the anode end of the second diode D41, the source of the second field effect transistor Q41, the second end of the fourth capacitor C41, the second end of the fifth capacitor C42, the anode end of the voltage stabilizing diode Z41 and the third end of the multi-gear regulating button are connected with the second end V− of the control circuit.

Preferably, the control circuit includes a voltage boosting and stabilizing chip U52, a third single chip computer U51, a voltage detection chip U53, a second inductor L51, a third field effect transistor Q51, a sixth capacitor C51, a fourth diode D51, a fifth resistor R51, a sixth resistor R52, a seventh resistor R53 and the multi-gear regulating button, wherein the second pin of the third single chip computer U51 is connected with the second end V− of the control circuit, the third pin of the third single chip computer U51 is connected with the second end of the seventh resistor R53, the fourth pin of the third single chip computer U51 is connected with the second end SW2 of the multi-gear regulating button and the first end of the fifth resistor R51, the fifth pin of the third single chip computer U51 is connected with the cathode end of the fourth diode D51, the first end of the sixth capacitor C51, the second pin of the voltage boosting and stabilizing chip U52, the third pin of the voltage detection chip U53, the second end of the fifth resistor R51 and the second end of the sixth resistor R52, and the sixth pin of the third single chip computer U51 is connected with the first end SW1 of the multi-gear regulating button, the first end of the sixth resistor R52 and the first pin of the voltage boosting and stabilizing chip U52;

the fifth pin of the voltage boosting and stabilizing chip U52 and the second end of the second inductor L51 are connected with the anode end of the fourth diode D51; the first pin of the voltage detection chip U53 and the grid of the third field effect transistor Q51 are connected with the second end of the seventh resistor R53; the drain of the third field effect transistor Q51 and the first end of the third inductor L51 are connected with the first end V+ of the control circuit; and the source of the third field effect transistor Q51, the fourth pin of the voltage boosting and stabilizing chip U52, the second pin of the voltage detection chip U53, the second end of the sixth capacitor C51 and the third end of the multi-gear regulating button are connected with the second end V− of the control circuit.

Preferably, the tail cap of the torch is only provided with two electric connection points for connecting with the outside.

To implement the objective above, in another aspect, the disclosure further provides a dimmable torch, which includes a lamp holder, a tube body and a tail cap. A battery is arranged in the tube body. A dimmable light source and a driving circuit are arranged in the lamp holder, wherein the first end of the driving circuit is connected with the dimmable light source, the anode of the second end is connected with the anode of the battery; and the cathode of the second end is connected with a tube body conductor. A control circuit is arranged in the tail cap of the torch, wherein the first end of the control circuit is connected with the tube body conductor and is further conductively connected with the cathode of the second end of the driving circuit by the tube body conductor; the second end of the control circuit is connected with the cathode of the battery; the control circuit is conductively connected with the battery by the driving circuit; a microcomputer control system on the control circuit can control the on/off of a loop of the cathode of the second end of the driving circuit and the cathode of the battery to implement dimming; the control circuit is only provided with two electric connection points: the first end and the second end; and a multi-gear regulating button of the control circuit is connected with the input end of the microcomputer control system to input a regulation instruction to the microcomputer control system.

Optionally, the control circuit further includes a voltage reducing and stabilizing chip which is characterized in that the first pin is connected with the first end of the control circuit, the third pin is connected with the second end of the control circuit, and the second pin is connected with the anode end of the first diode. A first single chip computer is characterized in that the second pin is connected with the second end of the control circuit, the third pin is connected with the grid of a first field effect transistor, the fourth pin is connected with the second end of the multi-gear regulating button and the first end of a second resistor, the fifth pin is connected with the cathode end of the first diode, the first end of a second capacitor, the first end of a third capacitor, the second end of a first resistor and the second end of the second resistor, and the sixth pin is connected with the first end of the multi-gear regulating button and the first end of the first resistor. The drain of the first field effect transistor and the first end of the first capacitor are connected with the first end of the control circuit; and the source of the first field effect transistor, the second end of the first capacitor, the second end of the second capacitor, the second end of the third capacitor and the third end of the multi-gear regulating button are connected with the second end of the control circuit.

Optionally, the control circuit further includes a second single chip computer which is characterized in that the second pin is connected with the second end of the control circuit, the third pin is connected with the grid of the second field effect transistor, the fourth pin is connected with the second end of the multi-gear regulating button and the first end of the fourth resistor, the fifth pin is connected with the cathode end of the third diode, the first end of the fifth capacitor, the cathode end of a voltage stabilizing diode, the second end of the third resistor and the second end of the fourth resistor, and the sixth pin is connected with the first end of the multi-gear regulating button and the first end of the third resistor. The first end of a first inductor and the cathode end of a second diode are connected with the first end of the control circuit; the second end of the first inductor, the first end of a fourth capacitor, and the anode end of the third diode are connected with the drain of a second field effect transistor; and the anode end of the second diode, the source of the second field effect transistor, the second end of the fourth capacitor, the second end of the fifth capacitor, the anode end of the voltage stabilizing diode and the third end of the multi-gear regulating button are connected with the second end of the control circuit.

Optionally, the control circuit further includes: a third single chip computer which is characterized in that the second pin is connected with the second end of the control circuit, the third pin is connected with the second end of a seventh resistor, the fourth pin is connected with the second end of the multi-gear regulating button and the first end of a fifth resistor, the fifth pin is connected with the cathode end of a fourth diode, the first end of a sixth capacitor, the second pin of a voltage boosting and stabilizing chip, the third pin of a voltage detection chip, the second end of the fifth resistor and the second end of a sixth resistor, and the sixth pin is connected with the first end of the multi-gear regulating button, the first end of the sixth resistor and the first pin of the voltage boosting and stabilizing chip. The fifth pin of the voltage boosting and stabilizing chip and the second end of a second inductor are connected with the anode end of the fourth diode; the first pin of the voltage detection chip and the grid of a third field effect transistor are connected with the second end of a seventh resistor; the drain of the third field effect transistor and the first end of a third inductor are connected with the first end of the control circuit; and the source of the third field effect transistor, the fourth pin of the voltage boosting and stabilizing chip, the second pin of the voltage detection chip, the second end of the sixth capacitor and the third end of the multi-gear regulating button are connected with the second end of the control circuit.

According to the technical scheme of the disclosure, the grouped multi-gear dimming mode of the torch can be conveniently controlled by combining the multi-gear regulating button with the single chip computer.

BRIEF DESCRIPTION OF THE DRAWINGS

The drawings here are to provide further understanding of the disclosure and constitute one part of the application, and the exemplary embodiments of the disclosure and the explanations thereof are intended to explain the disclosure, instead of improperly limiting the disclosure. In the drawings.

DETAILED DESCRIPTION OF THE EMBODIMENTS

It should be noted that, in the case of no conflict, the embodiments of the application and features therein can be combined with each other. The disclosure will be described below in detail with reference to the drawings and in conjunction with the embodiments.

Figure 1:
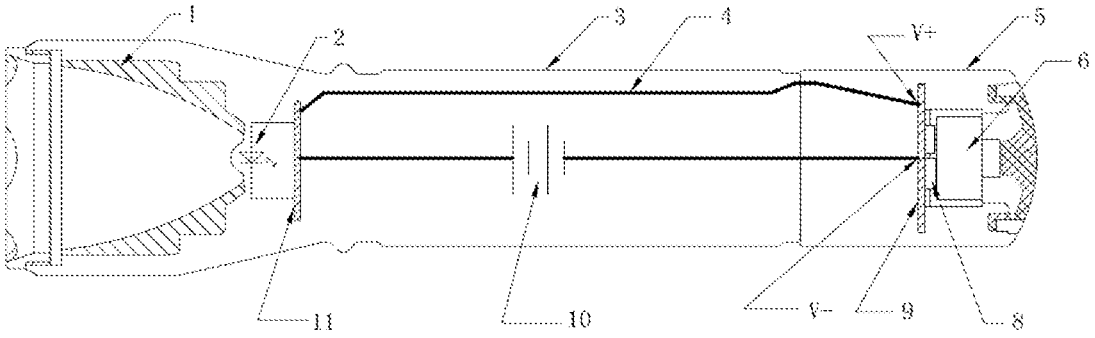
FIG. 1 is a diagram showing the structure of a dimmable torch according to one embodiment of the disclosure.

FIG. 1 is a diagram showing the structure of a dimmable torch according to one embodiment of the disclosure, as shown, the dimmable torch mainly includes: a lamp holder 1, a tube body 3 and a tail cap 5. A battery 10 is arranged in the tube body 3 of the dimmable torch; a dimmable light source 2 and a driving circuit 11 are arranged in the lamp holder 1; a control circuit 9 is arranged in the tail cap 5 of the torch and is provided with a multi-gear regulating button 6 and a microcomputer control system 8; and the tail cap 5 of the torch is provided with only two electric connection points.

Specifically, in FIG. 1, the first end of the driving circuit 11 is connected with the dimmable light source 2, and the anode of the second end is connected with the anode of the battery 10, and the cathode of the second end is connected with a tube body conductor 4. The first end V+ of the control circuit 9 is connected with the tube body conductor 4 and is conductively connected with the cathode of the second end of the driving circuit 11 by the tube body conductor 4; the second end V− of the control circuit 9 is connected with the cathode of the battery 10; the control circuit 9 is conductively connected with the battery 10 by the driving circuit 11; a microcomputer control system 8 on the control circuit 9 can control the on/off of a loop of the cathode of the second end of the driving circuit 11 and the cathode of the battery 10 to implement dimming; the control circuit 9 is only provided with two electric connection points: the first end V+ and the second end V−; and a multi-gear regulating button 6 is connected with the input end of the microcomputer control system 8 to input a regulation instruction to the microcomputer control system 8.

Figure 2:
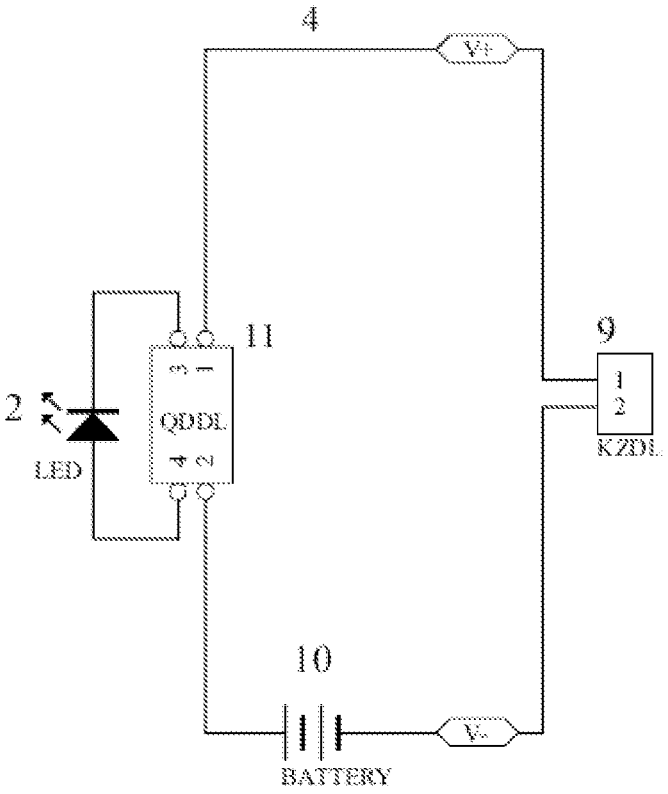
FIG. 2 is a diagram showing the composition of a circuit module of a dimmable torch according to one embodiment of the disclosure.

FIG. 2 is a diagram showing the composition of a circuit module of a dimmable torch according to one embodiment of the disclosure.

In FIG. 2, the composition of the circuit module of the dimmable torch is schematically described separately, the first end of the driving circuit 11 is connected with the dimmable light source 2, the anode of the second end is connected with the anode of the battery 10, and the cathode of the second end is connected with the tube body conductor 4. The first end V+ of the control circuit 9 is connected with the tube body conductor 4 and is further conductively connected with the cathode of the second end of the driving circuit 11 by the tube body conductor 4; the second end V− of the control circuit 9 is connected with the cathode of the battery 10; and the control circuit 9 is conductively connected with the battery 10 by the driving circuit 11 and is provided with only two electric connection points: the first end V+ and the second end V−.

Figure 3:
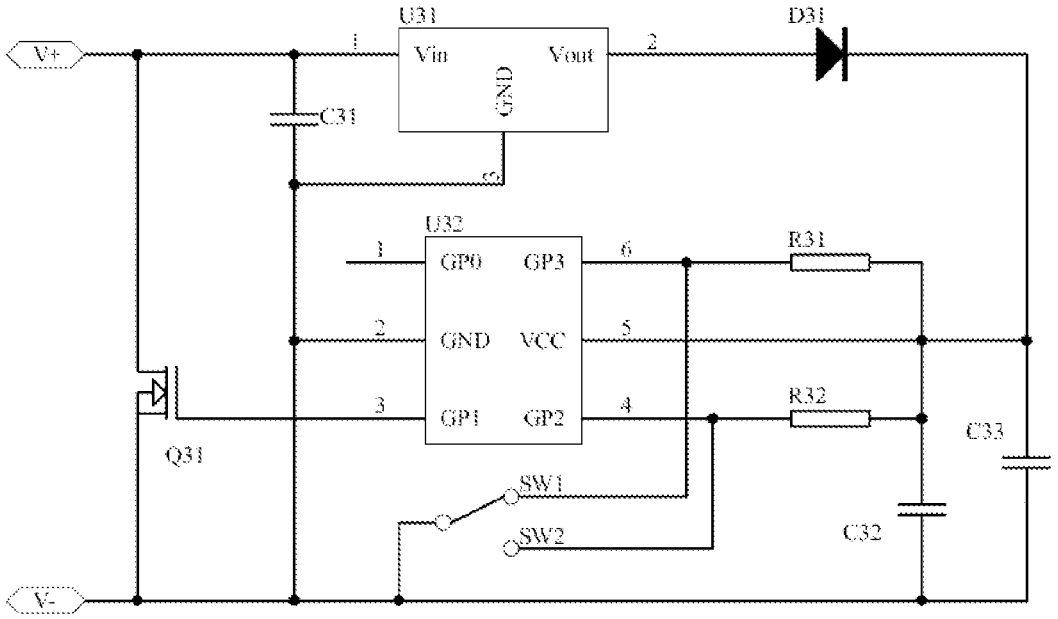
FIG. 3 is a diagram showing the principle of a control circuit of a dimmable torch according to the first embodiment of the disclosure.

FIG. 3 is a diagram showing the principle of a control circuit of a dimmable torch according to the first embodiment of the disclosure.

As shown in FIG. 3, the control circuit 9 includes a voltage reducing and stabilizing chip U31, a first single chip computer U32, a first field effect transistor Q31, a first capacitor C31, a second capacitor C32, a third capacitor C33, a first diode D31, a first resistor R31, a second resistor R32 and a multi-gear regulating button 6.

Specifically, the first pin of the voltage reducing and stabilizing chip U31 is connected with the first end V+ of the control circuit 9, the third pin is connected with the second end V− of the control circuit 9, and the second pin is connected with the anode end of the first diode D31. The first single chip computer U32 is characterized in that the second pin is connected with the second end V− of the control circuit 9, the third pin is connected with the grid of the first field effect transistor Q31, the fourth pin is connected with the second end SW2 of the multi-gear regulating button 6 and the first end of the second resistor R32, the fifth pin is connected with the cathode end of the first diode D31, the first end of the second capacitor C32, the first end of the third capacitor C33, the second end of the first resistor R31 and the second end of the second resistor R32, and the sixth pin is connected with the first end SW1 of the multi-gear regulating button 6 and the first end of the first resistor R31. The drain of the first field effect transistor Q31 and the first end of the first capacitor C31 are connected with the first end V+ of the control circuit 9; and the source of the first field effect transistor Q31, the second end of the first capacitor C31, the second end of the second capacitor C32, the second end of the third capacitor C33 and the third end of the multi-gear regulating button 6 are connected with the second end V− of the control circuit 9.

Figure 4:
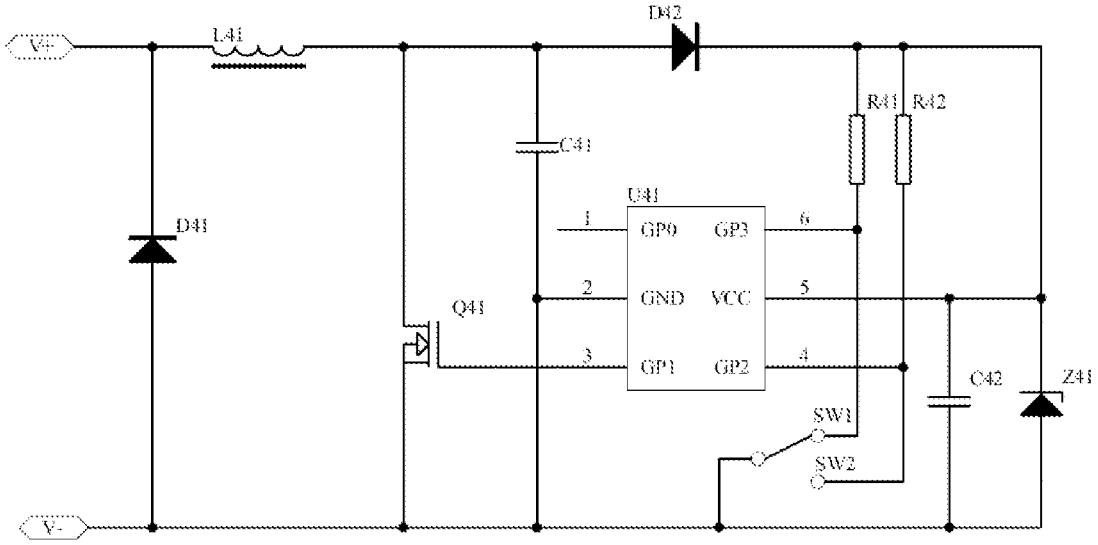
FIG. 4 is a diagram showing the principle of a control circuit of a dimmable torch according to the second embodiment of the disclosure.

FIG. 4 is a diagram showing the principle of a control circuit of a dimmable torch according to the second embodiment of the disclosure.

As shown in FIG. 4, optionally, the control circuit 9 further includes a second single chip computer U41, a second field effect transistor Q41, a fourth capacitor C41, a fifth capacitor C42, a first inductor L41, a second diode D41, a third diode D42, a voltage stabilizing diode Z41, a third resistor R41, a fourth resistor R42 and the multi-gear regulating button 6.

Specifically, in FIG. 4, the second single chip computer U41 is characterized in that the second pin is connected with the second end V− of the control circuit 9, the third pin is connected with the grid of the second field effect transistor Q41, the fourth pin is connected with the second end SW2 of the multi-gear regulating button 6 and the first end of the fourth resistor R42, the fifth pin is connected with the cathode end of the third diode D42, the first end of the fifth capacitor C42, the cathode end of the voltage stabilizing diode Z41, the second end of the third resistor R41 and the second end of the fourth resistor R42, and the sixth pin is connected with the first end SW1 of the multi-gear regulating button 6 and the first end of the third resistor R41. The first end of the first inductor L41 and the cathode end of the second diode D41 are connected with the first end V+ of the control circuit 9. The second end of the first inductor L41, the first end of the fourth capacitor C41, the anode end of the third diode D42 are connected with the drain of the second field effect transistor Q41. The anode end of the second diode D41, the source of the second field effect transistor Q41, the second end of the fourth capacitor C41, the second end of the fifth capacitor C42, the anode end of the voltage stabilizing diode Z41 and the third end of the multi-gear regulating button 6 are connected with the second end V− of the control circuit 9.

Figure 5:
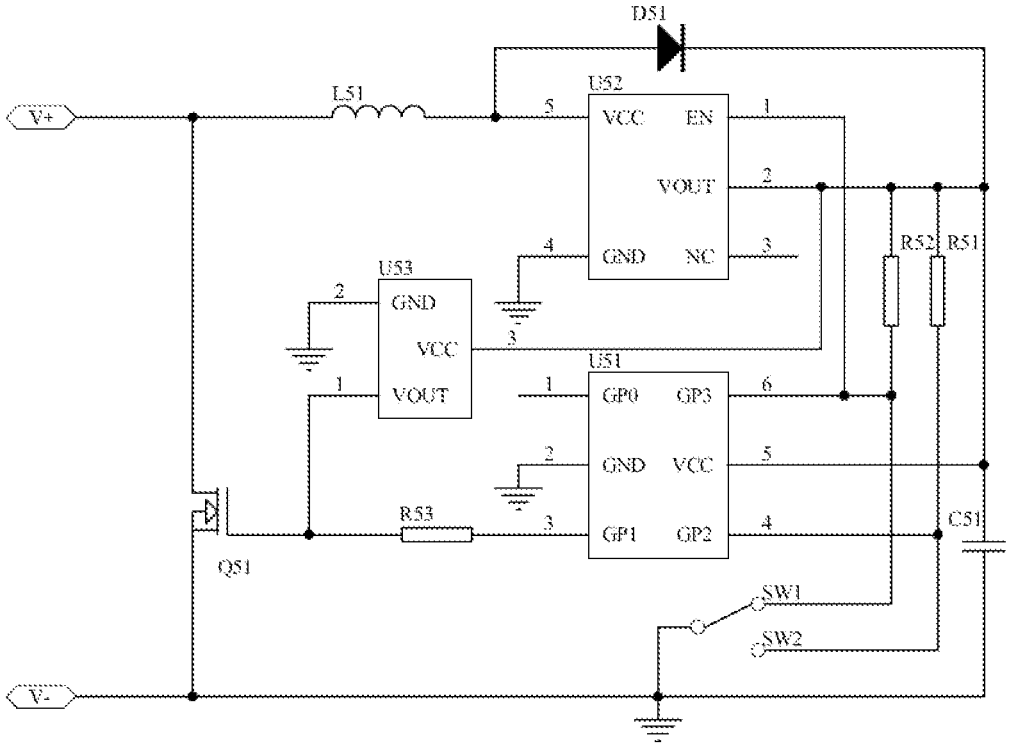
FIG. 5 is a diagram showing the principle of a control circuit of a dimmable torch according to the third embodiment of the disclosure.

FIG. 5 is a diagram showing the principle of a control circuit of a dimmable torch according to the third embodiment of the disclosure.

As shown in FIG. 5, optionally, the control circuit 9 further includes: a voltage boosting and stabilizing chip U52, a third single chip computer U51, a voltage detection chip U53, a second inductor L51, a third field effect transistor Q51, a sixth capacitor C51, a fourth diode D51, a fifth resistor R51, a sixth resistor R52, a seventh resistor R53 and the multi-gear regulating button 6.

Specifically, in FIG. 5, the third single chip computer U51 is characterized in that the second pin is connected with the second end V− of the control circuit 9, the third pin is connected with the second end of the seventh resistor R53, the fourth pin is connected with the second end SW2 of the multi-gear regulating button 6 and the first end of the fifth resistor R51, the fifth pin is connected with the cathode end of the fourth diode D51, the first end of the sixth capacitor C51, the second pin of the voltage boosting and stabilizing chip U52, the third pin of the voltage detection chip U53, the second end of the fifth resistor R51 and the second end of the sixth resistor R52, and the sixth pin is connected with the first end SW1 of the multi-gear regulating button 6, the first end of the sixth resistor R52 and the first pin of the voltage boosting and stabilizing chip U52. The fifth pin of the voltage boosting and stabilizing chip U52 and the second end of the second inductor L51 are connected with the anode end of the fourth diode D51. The first pin of the voltage detection chip U53 and the grid of the third field effect transistor Q51 are connected with the second end of the seventh resistor R53. The drain of the third field effect transistor Q51 and the first end of the third inductor L51 are connected with the first end V+ of the control circuit 9; and the source of the third field effect transistor Q51, the fourth pin of the voltage boosting and stabilizing chip U52, the second pin of the voltage detection chip U53, the second end of the sixth capacitor C51 and the third end of the multi-gear regulating button 6 are connected with the second end V− of the control circuit 9.

The dimmable torch provided in the embodiments of the disclosure overcomes the insufficiency of the dimming control function of the torch in the prior art, and includes: a lamp holder 1, a tube body 3 and a tail cap 5, wherein a battery 10 is arranged in the tube body 3; a dimmable light source 2 and a driving circuit 11 are arranged in the lamp holder 1; the first end of the driving circuit 11 is connected with the dimmable light source 2, the anode of the second end is connected with the anode of the battery 10, and the cathode of the second end is connected with a tube body conductor 4; the dimmable torch is characterized in that a control circuit 9 is arranged in the tail cap 5 of the torch, wherein the first end V+ of the control circuit 9 is connected with the tube body conductor 4 and is further conductively connected with the cathode of the second end of the driving circuit 11 by the tube body conductor 4; the second end V− of the control circuit is connected with the cathode of the battery 10; the control circuit 9 is conductively connected with the battery 10 by the driving circuit 11; a microcomputer control system 8 on the control circuit 9 can control the on/off of a loop of the cathode of the second end of the driving circuit 11 and the cathode of the battery 10 to implement dimming; the control circuit 9 is only provided with two electric connection points: the first end V+ and the second end V−; and a multi-gear regulating button 6 on the control circuit 9 is connected with the input end of the microcomputer control system 8 to input a regulation instruction to the microcomputer control system 8. Due to the adoption of the technical scheme of the disclosure, the grouped multi-gear dimming mode control of the torch can be implemented conveniently.

Obviously, those skilled in that art shall understand, in the control circuit, a multi-switch button switch and a control circuit board are combined to enable the single chip computer to judge the input status of each switch separately, wherein the control circuit board is provided with the single chip computer and each switch of the multi-switch button switch is connected with an input port of the single chip computer respectively, therefore, the grouped multi-gear control for the dimming mode of the torch is implemented simply and quickly; of course, a grouped multi-gear control can be further implemented in each group according to different judgment rules. The control circuit of a torch adopting a tail switch can be arranged in the tail cap and is connected with the driving circuit and the battery in the front of the torch by a tail cap conductor respectively; and the on/off of the power source of the driving circuit in the front of the torch is controlled by the single chip computer to control the dimming mode of the torch.

The above are only preferred embodiments of the disclosure and not intended to limit the disclosure. For those skilled in the art, various modifications and changes can be made in the disclosure. Any modifications, equivalent replacements, improvements and the like within the spirit and principle of the disclosure shall fall within the scope of protection of the disclosure.

What is claimed is:

1. A dimmable torch, comprising;

a lamp holder (1), a tube body (3) and a tail cap (5), wherein a battery (10) is arranged in the tube body (3); a dimmable light source (2) is arranged in the lamp holder (1); a control circuit (9) is arranged in the tail cap (5) and is provided with a multi-gear regulating button (6) and a microcomputer control system (8); and the tail cap (5) of the torch is provided with only two electric connection points, further comprising:

a tube body conductor (4); and a driving circuit (11) which is arranged in the lamp holder (1), wherein a first end of the driving circuit (11) is connected with the dimmable light source (2); the anode and the cathode of a second end of the driving circuit (11) are connected with the anode of the battery (10) and the tube body conductor (4) respectively; a first end (V+) of the control circuit (9) is connected with the tube body conductor (4) and is further conductively connected with the cathode of the second end of the driving circuit (11) by the tube body conductor (4); a second end (V−) of the control circuit (9) is connected with the cathode of the battery (10); the control circuit (9) is conductively connected with the battery (10) by the driving circuit (11); the microcomputer control system (8) on the control circuit (9) can control the on/off of a loop of the cathode of the second end of the driving circuit (11) and the cathode of the battery (10) to implement dimming; the control circuit (9) is only provided with two electric connection points: the first end (V+) and the second end (V−); and the multi-gear regulating button (6) is connected with the input end of the microcomputer control system (8) to input a regulation instruction to the microcomputer control system (8).

2. The dimmable torch according to claim 1, wherein the control circuit (9) is included in the tail cap (5) of the torch; the multi-gear regulating button (6) is used for pushing the microcomputer control system (8) to regulate the brightness of the torch; and the tail cap (5) of the torch is only provided with two electric connection points: a first end (V+) and a second end (V−) of the control circuit (9).

3. The dimmable torch according to claim 1, wherein the control circuit (9) comprises a voltage reducing and stabilizing chip (U31), a first single chip computer (U32), a first field effect transistor (Q31), a first capacitor (C31), a second capacitor (C32), a third capacitor (C33), a first diode (D31), a first resistor (R31), a second resistor (R32) and the multi-gear regulating button (6); the first pin of the voltage reducing and stabilizing chip (U31) is connected with a first end (V+) of the control circuit (9), the third pin is connected with a second end (V−) of the control circuit (9), and the second pin of the voltage reducing and stabilizing chip (U31) is connected with the anode end of the first diode (D31), wherein the second pin of the first single chip computer (U32) is connected with the second end (V−) of the control circuit (9), the third pin of the first single chip computer (U32) is connected with the grid of the first field effect transistor (Q31), the fourth pin of the first single chip computer (U32) is connected with the second end (SW2) of the multi-gear regulating button (6) and the first end of the second resistor (R32), the fifth pin of the first single chip computer (U32) is connected with the cathode end of the first diode (D31), the first end of the second capacitor (C32), the first end of the third capacitor (C33), the second end of the first resistor (R31) and the second end of the second resistor (R32) and the sixth pin of the first single chip computer (U32) is connected with the first end (SW1) of the multi-gear regulating button (6) and the first end of the first resistor (R31);

the drain of the first field effect transistor (Q31) and the first end of the first capacitor (C31) are connected with the first end (V+) of the control circuit (9); and the source of the first field effect transistor (Q31), the second end of the first capacitor (C31), the second end of the second capacitor (C32), the second end of the third capacitor (C33) and the third end of the multi-gear regulating button (6) are connected with the second end (V−) of the control circuit (9).

4. The dimmable torch according to claim 1, wherein the control circuit (9) further comprises a first single chip computer (U41), a first field effect transistor (Q41), a first capacitor (C41), a second capacitor (C42), a first inductor (L41), a first diode (D41), a second diode (D42), a voltage stabilizing diode (Z41), a first resistor (R41), a second resistor (R42) and the multi-gear regulating button (6), wherein the second pin of the first single chip computer (U41) is connected with a second end (V−) of the control circuit (9), the third pin of the first single chip computer (U41) is connected with the grid of the first field effect transistor (Q41), the fourth pin of the first single chip computer (U41) is connected with the second end (SW2) of the multi-gear regulating button (6) and the first end of the fourth resistor (R42), the fifth pin of the first single chip computer (U41) is connected with the cathode end of the second diode (D42), the first end of the second capacitor (C42), the cathode end of the voltage stabilizing diode (Z41), the second end of the first resistor (R41) and the second end of the second resistor (R42), and the sixth pin of the first single chip computer (U41) is connected with the first end (SW1) of the multi-gear regulating button (6) and the first end of the first resistor (R41);

the first end of the first inductor (L41) and the cathode end of the first diode (D41) are connected with a first end (V+) of the control circuit (9); the second end of the first inductor (L41), the first end of the fourth capacitor (C41) and the anode end of the second diode (D42) are connected with the drain of the first field effect transistor (Q41); and the anode end of the first diode (D41), the source of the first field effect transistor (Q41), the second end of the first capacitor (C41), the second end of the second capacitor (C42), the anode end of the voltage stabilizing diode (Z41) and the third end of the multi-gear regulating button (6) are connected with the second end (V−) of the control circuit (9).

5. The dimmable torch according to claim 1, wherein the control circuit (9) comprises a voltage boosting and stabilizing chip (U52), a first single chip computer (U51), a voltage detection chip (U53), a first inductor (L51), a first field effect transistor (Q51), a first capacitor (C51), a first diode (D51), a first resistor (R51), a second resistor (R52), a third resistor (R53) and the multi-gear regulating button (6), wherein the second pin of the first single chip computer (U51) is connected with a second end (V−) of the control circuit (9), the third pin of the first single chip computer (U51) is connected with the second end of the third resistor (R53), the fourth pin of the first single chip computer (U51) is connected with the second end (SW2) of the multi-gear regulating button (6) and the first end of the first resistor (R51), the fifth pin of the first single chip computer (U51) is connected with the cathode end of the first diode (D51), the first end of the first capacitor (C51), the second pin of the voltage boosting and stabilizing chip (U52), the third pin of the voltage detection chip (U53), the second end of the first resistor (R51) and the second end of the second resistor (R52), and the sixth pin of the first single chip computer (U51) is connected with the first end (SW1) of the multi-gear regulating button (6), the first end of the second resistor (R52) and the first pin of the voltage boosting and stabilizing chip (U52);

the fifth pin of the voltage boosting and stabilizing chip (U52) and the second end of the first inductor (L51) are connected with the anode end of the first diode (D51); the first pin of the voltage detection chip (U53) and the grid of the first field effect transistor (Q51) are connected with the second end of the third resistor (R53); the drain of the first field effect transistor (Q51) and the first end of the first inductor (L51) are connected with a first end (V+) of the control circuit (9); and the source of the first field effect transistor (Q51), the fourth pin of the voltage boosting and stabilizing chip (U52), the second pin of the voltage detection chip (U53), the second end of the first capacitor (C51) and the third end of the multi-gear regulating button (6) are connected with the second end (V−) of the control circuit (9).

* * * * *